US005463991A

United States Patent [19]

Krotky et al.

[11] Patent Number: 5,463,991

[45] Date of Patent: Nov. 7, 1995

[54] CYLINDER HEAD THREADED CONNECTION ARRANGEMENT

[75] Inventors: Peter Krotky, Simmozheim; Markus Bauhofer, Weissach; Walter Heinzelmann, Reutlingen, all of Germany

[73] Assignee: Ing. h.c.F. Porsche AG, Weissach, Germany

[21] Appl. No.: 279,649

[22] Filed: Jul. 25, 1994

[30] Foreign Application Priority Data

Jul. 23, 1993 [DE] Germany ..... 43 24 790.3

[51] Int. Cl.[6] ..... F02F 1/00

[52] U.S. Cl. ..... 123/195 R; 123/193.3

[58] Field of Search ..... 123/195 R, 193.3

[56] References Cited

U.S. PATENT DOCUMENTS 4,013,058 3/1977 Hafner et al. ..... 123/195 R

FOREIGN PATENT DOCUMENTS 1275912 12/1960 France ..... 123/195 R
3939230 5/1991 Germany .

*Primary Examiner*—Noah P. Kamen
*Attorney, Agent, or Firm*—Evenson McKeown Edwards & Lenahan

[57] ABSTRACT

An annular gap formed between a shaft of a cylinder head bolt and adjacent components is filled with a wire knit for example to increase the heat transfer. The improved heat transfer reduces the increase in bolt force, especially after a cold start of the internal combustion engine.

9 Claims, 2 Drawing Sheets

CYLINDER HEAD THREADED CONNECTION ARRANGEMENT

BACKGROUND AND SUMMARY OF THE INVENTION

The invention relates to a cylinder head bolted connection of an internal combustion engine.

Cylinder head bolts, especially of internal combustion engines made of lightweight metal, are subjected to high stresses, for example, after a cold start. These stresses result from the differences in thermal expansion between the housing parts of the internal combustion engine on the one hand and the cylinder head bolts on the other. While the components such as the cylinder head and adjoining areas of the cylinder block which are made of an aluminum alloy for example and are heated relatively rapidly by the combustion process in the combustion chamber, expand by comparatively large amounts, the cylinder head bolts which are made of a steel alloy and are insulted by an air gap along nearly their entire length remain at a low temperature level for a relatively long time and are subject to less expansion; consequently, during a certain time interval, there is a sharp increase in the bolt forces transmitted by the cylinder head bolts. This can lead to undesired flow of the material in the contact surfaces of the cylinder head for the heads of the cylinder head bolts.

The bolt force increase also occurs to a varying extent in the cylinder head bolts of an internal combustion engine so that unequal expansions and consequently unequal pressures can be exerted on the cylinder head gasket located between the cylinder head and the cylinder block. Consequently, this gasket in unfavorable cases can burn pointwise, in turn leading to total failure of the internal combustion engine. These problems occur to a greater degree in air cooled internal combustion engines.

German Patent Document DE 39 39 230 A1 teaches filling holes for cylinder head bolts designed as tie rods with a permanently plastic material after the bolts are inserted, to avoid corrosion, for oil-tight separation, and to avoid bolt vibrations.

An object of the invention is to reduce the undesired increase in the bolt forces transmitted by the cylinder head bolts of an internal combustion engine to the greatest degree possible.

This object is achieved according to preferred embodiments of the invention by providing heat-conducting material in the annular gap between the bolt shaft and wall sections of the engine.

When a heat-conducting material is located in an internal combustion engine in the space, in the form of an annular gap, necessarily left between the shaft of a cylinder head bolt and the adjacent housing walls, said material being in positive contact both with the shaft and the housing walls in the system, the clearly improved heat flux relative to that obtained with an air gap produces a comparatively small time delay between the increasing heating of the housing parts and the cylinder head bolts. Consequently, the cylinder head bolts expand more rapidly than the housing parts, so the difference in expansion is less and the bolt force increase is markedly reduced.

Flow of the material in the vicinity of the bold head support is retarded and uniform expansion of cylinder head bolts of a cylinder for example is reduced to a degree that does not have an adverse effect on the cylinder head gasket.

Advantageously, existing cylinder head bolts can be operated with significantly higher safety reserves or they can be optimized in a manner that reduces both cost and weight with regard to their geometric dimensions and their material quality.

In one advantageous embodiment of the invention, a wire knit, a fine-grained metal powder, or an aluminum bushing can be used as the material placed in the annular gap.

A wire knit can be used economically as a commercial component, since because of its axial and radial crushability, it can be inserted into the annular gap in such fashion that, after the cylinder head has been bolted down, it presses against the adjacent components under radial pressure, ensuring good heat transfer.

A fine-grained metal powder according to another preferred embodiment of the invention largely expels the air in the annular gap and forms a comparatively large surface for heat transfer. As a result of the locally high temperature, by a suitable choice of the metal powder, welding of the grains can be promoted which improves heat flux because of the resultant metallic bridges. Trouble-free disassembly of the cylinder head bolts is also ensured.

A comparatively soft aluminum bushing according to another preferred embodiment of the invention is crushed within certain limits when the cylinder head bolt is screwed into the annular gap and thereby offers a heat flux with positive contact over a large area.

Alternatively, the annular gap can be filled with a liquid, preferably oil, with additional measures being required for sealing according to another preferred embodiment of the invention. If the annular gap extends at least partially into all of the components involved in the cylinder head bolted connection, the heat flux can be made uniform so that all area of the bolt shaft are heated largely uniformly.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
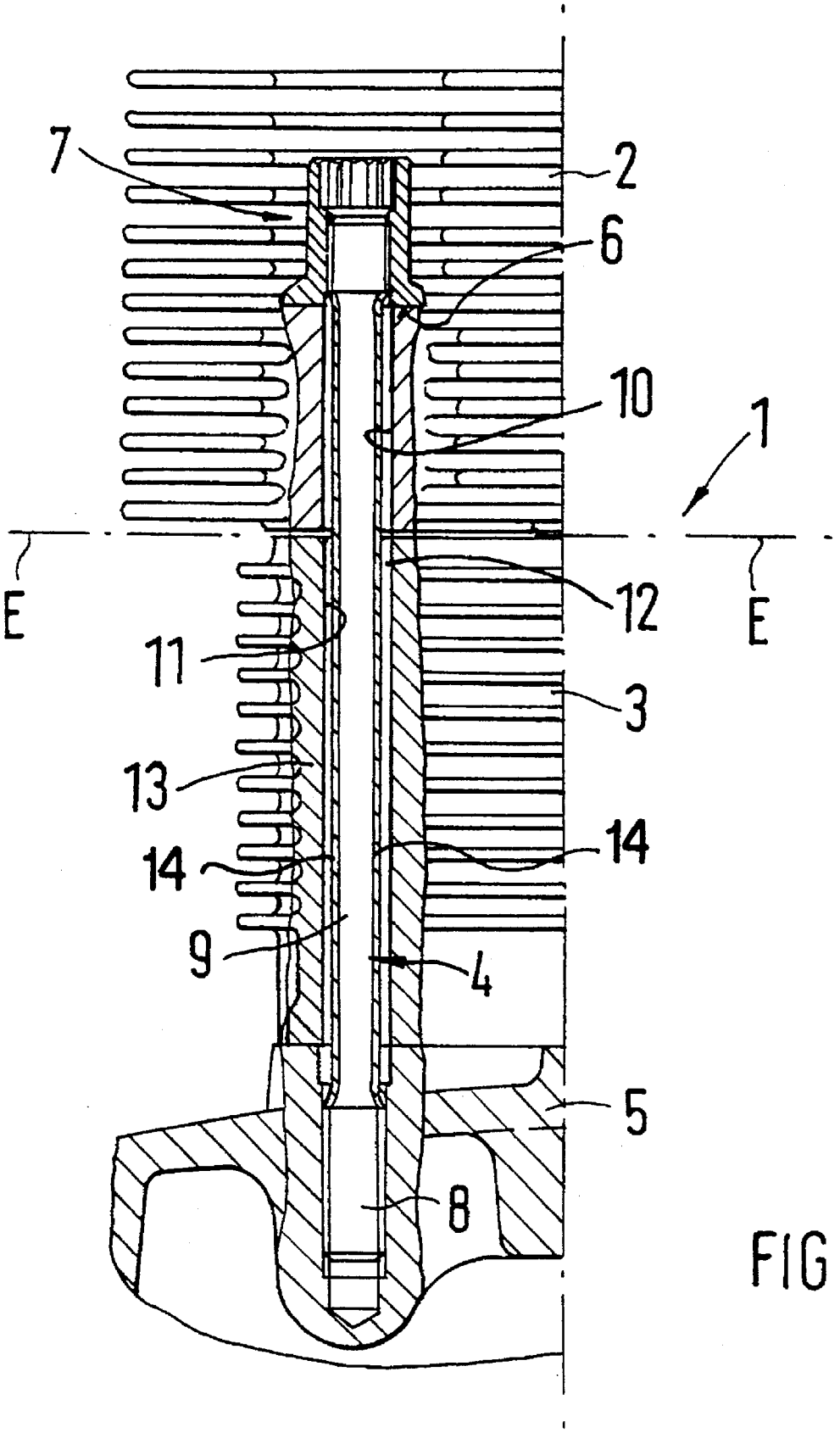
FIG. 1 is a schematic sectional view of a cylinder head bolted connection constructed according to a preferred embodiment of the invention.

A cylinder 1 of an air-cooled internal combustion engine has a cylinder head 2 and a cylinder block 3, which are ribbed for cooling purposes. Cylinder 1 is held on a crankcase 5 by cylinder head bolts 4 which traverse cylinder block 3 and abut cylinder head 2.

Cylinder head bolt 4 is designed as a tie rod and has a head section 7 abutting a supporting surface 6 on cylinder head 2, a threaded section 8 tapped in crankcase 5, and a shaft 9 therebetween.

Through openings 10 and 11 are provided in cylinder head 2 and in cylinder block 3, whose diameters are larger than those of shaft 9 so that a space designed as an annular gap 12 results. Annular gap 12 passes through a wall 13 of cylinder block 3 by means of through opening 11 and extends partially in cylinder head 2 and partially in crankcase 5, passing through a separating plane E provided with a cylinder head gasket, and contains a heat transmitting material 14.

Figure 2:
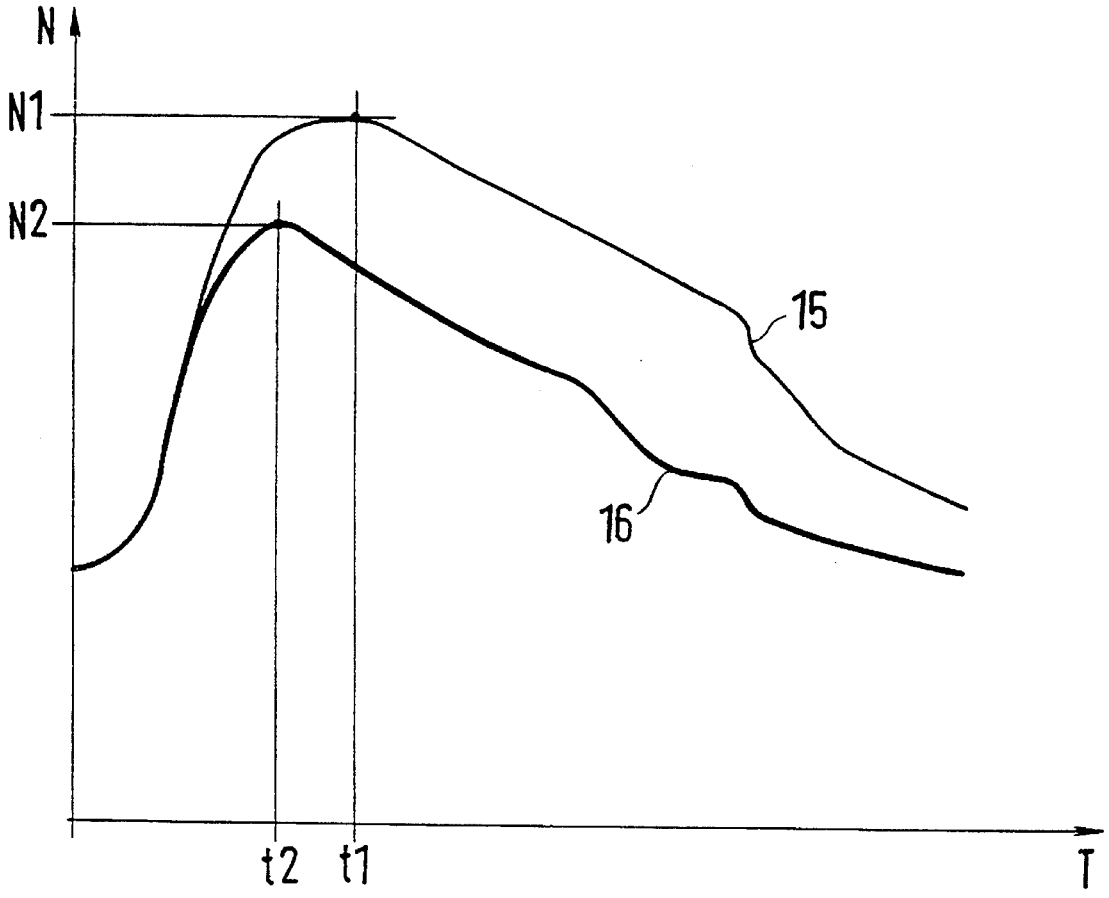
FIG. 2 is a schematic diagram of bolt force as a function of time, depicting advantages of the present invention.

The diagram shown in FIG. 2 has a first curve 15 that plots the known curve of the increase in bolt force N in time T following a cold start of the internal combustion engine.

As a result of the clearly different expansions of cylinder head 2 and cylinder block 3 on the one hand and cylinder bolt 4 on the other, the force N transmitted by it rises steeply to begin with, until at a point in time t1 of about 2 minutes a maximum is reached at N1. Then the curve falls off gradually as a result of the increasing heat transfer to the cylinder head bolt 4.

A second curve 16 shows the curve with a wire knit placed in annular gap 12 according to preferred embodiments of the present invention.

As a result of the improved, i.e., faster heat transfer from cylinder head 2 or cylinder block 3 to cylinder head bolt 4, the latter expands more rapidly than before. The difference between the expansion of cylinder head bolt 4 and a combination of cylinder head 2 and cylinder block 3 is reduced, so that at a point in time t2 about 30 seconds earlier a much lower maximum N2 of bolt force N is reached.

The difference between values N1 and N2, depending on the design of the bolted connection, amounts to several kilonewtons.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Cylinder head bolted connection of an internal combustion engine, comprising:

cylinder head bolts designed as tie rods and including:

a head section, a threaded section, and a shaft section extending between said head section and threaded section, said shaft section being disposed in use leaving an annular gap between the shaft section and engine housing walls, and heat conducting material placed in the annular gap in direct contact with the shaft section and the housing walls, wherein the heat-conducting material is a wire knit placed in the annular gap as a material that, under radial pressure, abuts the shaft section and the housing walls.

2. Bolted connection according to claim 1, wherein the annular gap extends partially in an engine cylinder head and in an engine crankcase, traversing a wall of an engine cylinder block.

3. Bolted connection according to claim 1, wherein the annular gap extends along a through opening in an engine cylinder block and partially into an adjoining cylinder head and a crankcase.

4. Cylinder head bolted connection, of an internal combustion engine, comprising:

cylinder head bolts designed as tie rods and including:

a head section, a threaded section, and a shaft section extending between said head section and threaded section, said shaft section being disposed in use leaving an annular gap between the shaft section and engine housing walls, and heat conducting material placed in the annular gap in direct contact with the shaft section and the housing walls, wherein fine-grained metal powder is used as the heat-conducting material.

5. Bolted connection according to claim 4, wherein the annular gap extends partially in an engine cylinder head and in an engine crankcase, traversing a wall of an engine cylinder block.

6. Bolted connection according to claim 4, wherein the annular gap extends along a through opening in an engine cylinder block and partially into an adjoining cylinder head and a crankcase.

7. Cylinder head bolted connection, of an internal combustion engine, comprising:

cylinder head bolts designed as tie rods and including:

a head section, a threaded section, and a shaft section extending between said head section and threaded section, said shaft section being disposed in use leaving an annular gap between the shaft section and engine housing walls, and heat conducting material placed in the annular gap in direct contact with the shaft section and the housing walls, wherein a bushing made of an aluminum alloy is used as the heat-conducting material.

8. Bolted connection according to claim 7, wherein the annular gap extends partially in an engine cylinder head and in an engine crankcase, traversing a wall of an engine cylinder block.

9. Bolted connection according to claim 7, wherein the annular gap extends along a through opening in an engine cylinder block, and partially into an adjoining cylinder head and a crankcase.

* * * * *